US006618884B1

(12) United States Patent
Wu

(10) Patent No.: US 6,618,884 B1
(45) Date of Patent: Sep. 16, 2003

(54) INFLATABLE MATTRESS WITH INTEGRATED UPPER AND LOWER INFLATABLE BODIES

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 10/192,320

(22) Filed: Jul. 11, 2002

(51) Int. Cl.[7] ..... A47C 27/10
(52) U.S. Cl. ..... 5/706; 5/707; 5/655.3
(58) Field of Search ..... 5/706, 710, 711, 5/712, 644, 655.3, 707

(56) References Cited

U.S. PATENT DOCUMENTS 2,604,641 A * 7/1952 Reed ..... 5/710
5,561,873 A * 10/1996 Weedling ..... 5/713
5,598,593 A * 2/1997 Wolfe ..... 5/710

* cited by examiner

*Primary Examiner*—Teri Pham Luu
*Assistant Examiner*—Fredrick Conley
(74) *Attorney, Agent, or Firm*—Nixon & Vanderhye P.C.

(57) ABSTRACT

An inflatable mattress includes an upper mattress body defining several upper chambers that are in fluid communication with one another, and has a bottom wall formed with a first hole which is fluid communication with an adjacent one of the upper chambers. A lower mattress body is disposed below the upper mattress body, defines several lower chambers that are in fluid communication with one another, and has a top wall formed with a second hole which is in fluid communication with an adjacent one of the lower chambers. The periphery of the second hole is integrally connected to the periphery of the first hole so as to permit adjoining of the first and second holes, thereby permitting fluid communication of the upper chambers with the lower chambers via the first and second holes.

3 Claims, 5 Drawing Sheets

INFLATABLE MATTRESS WITH INTEGRATED UPPER AND LOWER INFLATABLE BODIES

BACKGROUND OF THE INVENTION

1. Field of the Invention

The present invention relates to an inflatable mattress, more particularly to an inflatable mattress with integrated upper and lower mattress bodies.

2. Description of the Related Art

Referring to FIGS. 1 and 2, a conventional inflatable mattress 90 is shown to include a bottom wall 92, a top wall 91, and a plurality of uniformly spaced apart pull bands 93 interposed between and connected to the top and bottom walls 91, 92 to define a plurality of air chambers 94 which are in fluid communication with one another. An air-injecting valve is provided for injecting air into the chambers 94.

Referring to FIG. 2, due to the presence of a seam between each adjacent pair of the air chambers 94, a plurality of depressions are formed on the top wall 91 of the inflatable mattress 90. As such, when the user lies down on the top wall 91, the inflatable mattress cannot provide satisfactory support for the user's body. In instances where two users share the same inflatable mattress, the inflatable mattress will create a rolling effect. That is, when one user tosses and turns at one end of the inflatable mattress, the other user at the other end will be jostled.

SUMMARY OF THE INVENTION

Therefore, the object of this invention is to provide an inflatable mattress with integrated upper and lower mattress bodies, which provides better comfort in comparison to the aforesaid conventional inflatable mattress.

Accordingly, an inflatable mattress according to the present invention includes an inflatable upper mattress body and an inflatable lower mattress body. The inflatable upper mattress body defines a plurality of elongated parallel upper chambers that extend in a first longitudinal direction, and that are in fluid communication with one another, and has a bottom wall that confines bottom sides of the upper chambers, that has a peripheral portion, and that is formed with a first hole which is disposed adjacent to the peripheral portion, which is in fluid communication with an adjacent one of the upper chambers, and which has a periphery. The inflatable lower mattress body is disposed below and is aligned with the upper mattress body, defines a plurality of elongated parallel lower chambers that extend in a second longitudinal direction, and that are in fluid communication with one another, and has a top wall that confronts the bottom wall of the upper mattress body, that confines top sides of the lower chambers, that has a peripheral portion, and that is formed with a second hole which is disposed adjacent to the peripheral portion of the top wall, which is in fluid communication with an adjacent one of the lower chambers, which is vertically registered with the first hole, and which has a periphery. Each of the lower chambers has a transverse cross-section greater than that of the upper chamber. The periphery of the second hole is integrally connected to the periphery of the first hole so as to permit adjoining of the first and second holes, thereby permitting fluid communication of the upper chambers with the lower chambers via the first and second holes.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
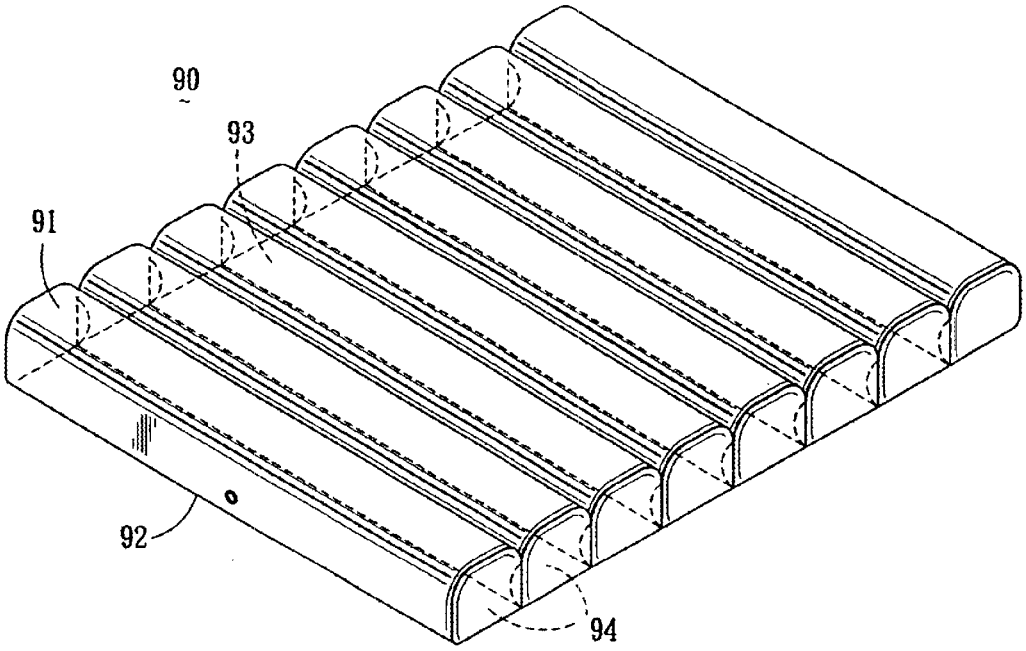
FIG. 1 PRIOR ART
FIG. 1 is a perspective view of a conventional inflatable mattress.
Figure 2:
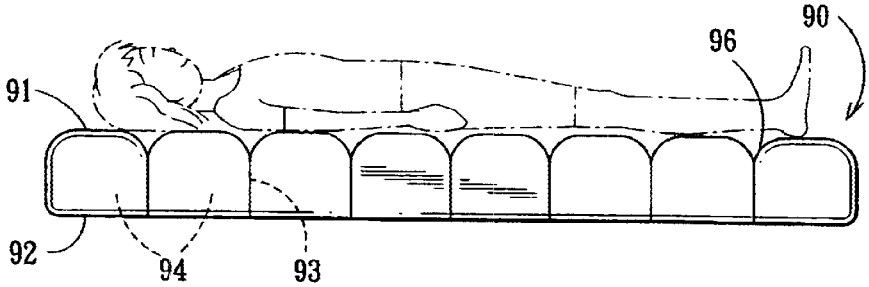
FIG. 2 PRIOR ART
FIG. 2 is a side view of the conventional inflatable mattress in use.
Figure 3:
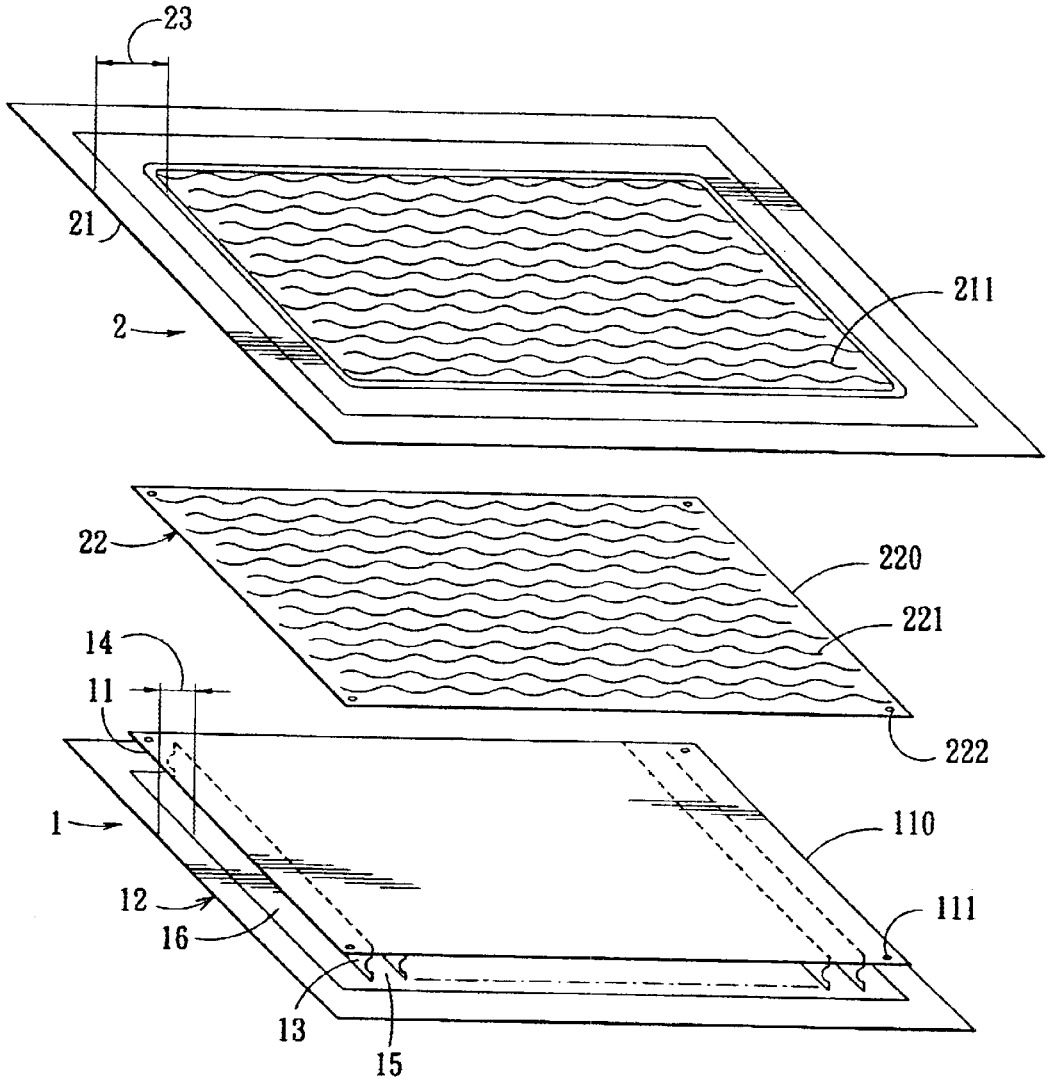
FIG. 3 is an exploded view of a preferred embodiment of an inflatable mattress according to the present invention.
Figure 4:
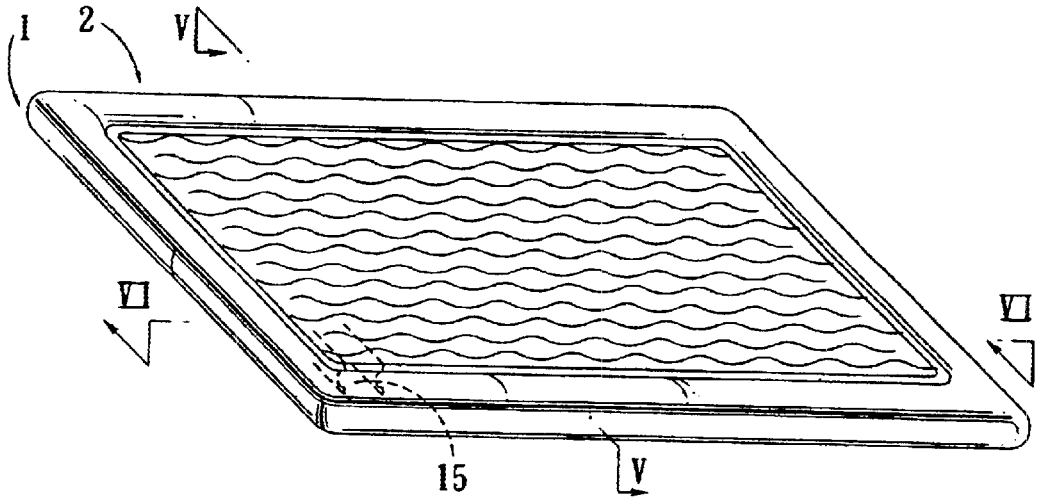
FIG. 4 is a perspective view of the preferred embodiment shown in FIG. 3.
Figure 5:
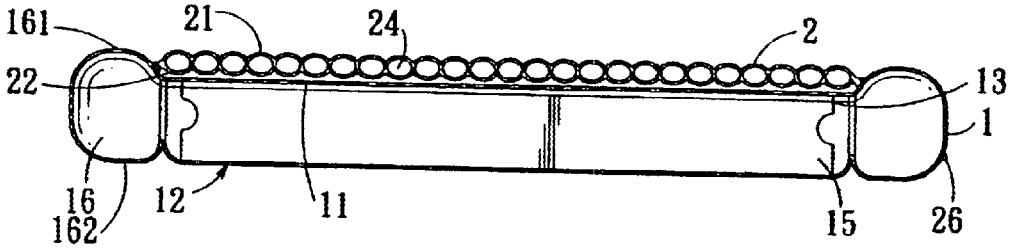
FIG. 5 is a cross sectional view of the preferred embodiment taken along lines V—V of FIG. 4.
Figure 6:
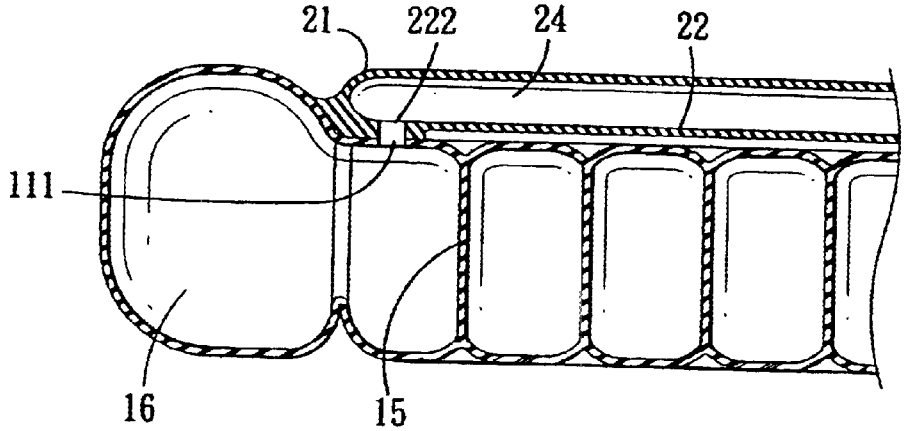
FIG. 6 is a fragmentary cross sectional view of the preferred embodiment taken along lines VI—VI of FIG. 4.

Referring to FIGS. 3 to 6, the preferred embodiment of an inflatable mattress according to the present invention is shown to include a rectangular inflatable upper mattress body 2 and a rectangular inflatable lower mattress body 1.

As illustrated, the inflatable upper mattress body 2 defines a plurality of elongated parallel upper chambers 24 that extend in a first longitudinal direction, and that are in fluid communication with one another, and has a bottom wall 22 that confines bottom sides of the upper chambers 24, that has a peripheral portion 220, and that is formed with four first holes 222 at four corners thereof adjacent to the peripheral portion 220. Each of the first holes 222 is in fluid communication with an adjacent one of the upper chambers 24, and has a periphery.

The inflatable lower mattress body 1 is disposed below and is aligned with the upper mattress body 2, defines a plurality of elongated parallel lower chambers 15 that extend in a second longitudinal direction, and that are in fluid communication with one another, and has a top wall 11 that confronts the bottom wall 22 of the upper mattress body 2, that confines top sides of the lower chambers 15, that has a peripheral portion 110, and that is formed with four second holes 111 at four corners thereof adjacent to the peripheral portion 110 of the top wall 11. Each of the second holes 111 is in fluid communication with an adjacent one of the lower chambers 15, is vertically registered with the respective one of the first holes 222, and has a periphery. Each of the lower chambers 15 has a transverse cross-section greater than that of the upper chamber 24. The periphery of each of the second holes 111 is integrally connected to the periphery of the respective one of the first holes 222 so as to permit adjoining of the respective first and second holes 222, 111, thereby permitting fluid communication of the upper chambers 24 with the lower chambers 15 via the first and second holes 222, 111.

In this preferred embodiment, the second longitudinal direction is perpendicular to the first longitudinal direction. The lower mattress body 1 includes a bottom wall 12 that confines bottom sides of the lower chambers 15 and that has a peripheral portion 14. The upper mattress body 2 includes a top wall 21 which is integrally connected to the bottom wall 22 along lines 211, 221 and which has a peripheral portion 23 that is integrally connected to the peripheral portion 220 of the bottom wall 22 of the upper mattress body 2 so as to form the upper chambers 24. The peripheral portion 23 of the top wall 21 extends outwardly and downwardly from the peripheral portion 220 of the bottom wall 22 of the upper mattress body 2 to integrally connect with the peripheral portion 14 of the bottom wall 12 of the lower mattress body 1 so as to form a looped channel 16 which surrounds the upper and lower chambers 24, 15 and which is in fluid communication with the lower chambers 15. The looped channel 16 has a top end that is substantially flush with the top wall 21 of the upper mattress body 2, and a bottom end that is substantially flush with the bottom wall 12 of the lower mattress body 1. In use, when the user lies down on the upper mattress body 2, the latter sinks relative to the lower mattress body 1 due to the user's weight, which, in turn, results in rising of the top end 161 of the looped channel 16 above the top wall 21 of the upper mattress body 2, thereby preventing the user from falling from the upper mattress body 2.

In this preferred embodiment, a plurality of uniformly spaced apart pull bands 13 are disposed between and connected to the top and bottom walls 11, 12 of the lower mattress body 20 at predetermined positions to confine the lower chambers 15. Preferably, an air-injection valve 26 is mounted on the lower mattress body 20 for inflating and deflating air into the upper and lower chambers 24, 15.

In the present invention, since the upper chambers 24 are in fluid communication with the lower chambers 15 via the first and second holes 222, 111 at four corners of the inflatable mattress, the aforesaid rolling effect can be minimized. In addition, the upper chambers 24 are configured to be smaller than the lower chambers 15 and are densely packed to provide better support for the user's body.

Figure 7:
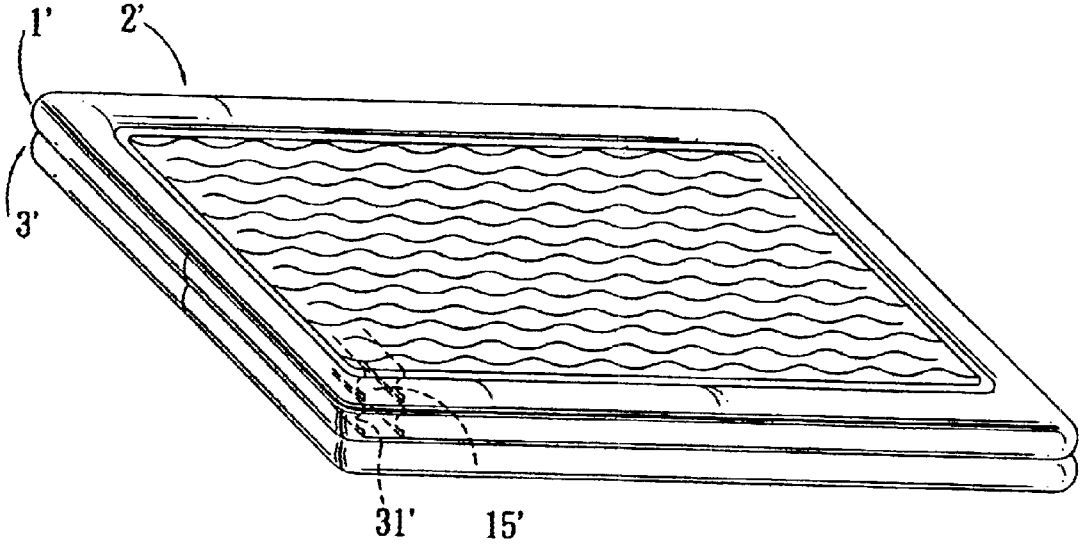
FIG. 7 is a perspective view of a modified preferred embodiment of the present invention.

Referring to FIG. 7, a modified preferred embodiment of an inflatable mattress according to the present invention is shown to have a structure similar the previous embodiment in construction. The main difference resides in that an inflatable supporting mattress body 3', which is configured to be similar to the lower mattress body 1', is disposed below the lower mattress body 1', and defines a plurality of interconnected air chambers 31'. The leftmost air chamber 31' in the supporting mattress body 3' is in fluid communication with an adjacent one of the lower chambers 15' in the lower mattress body 1'.

Figure 8:
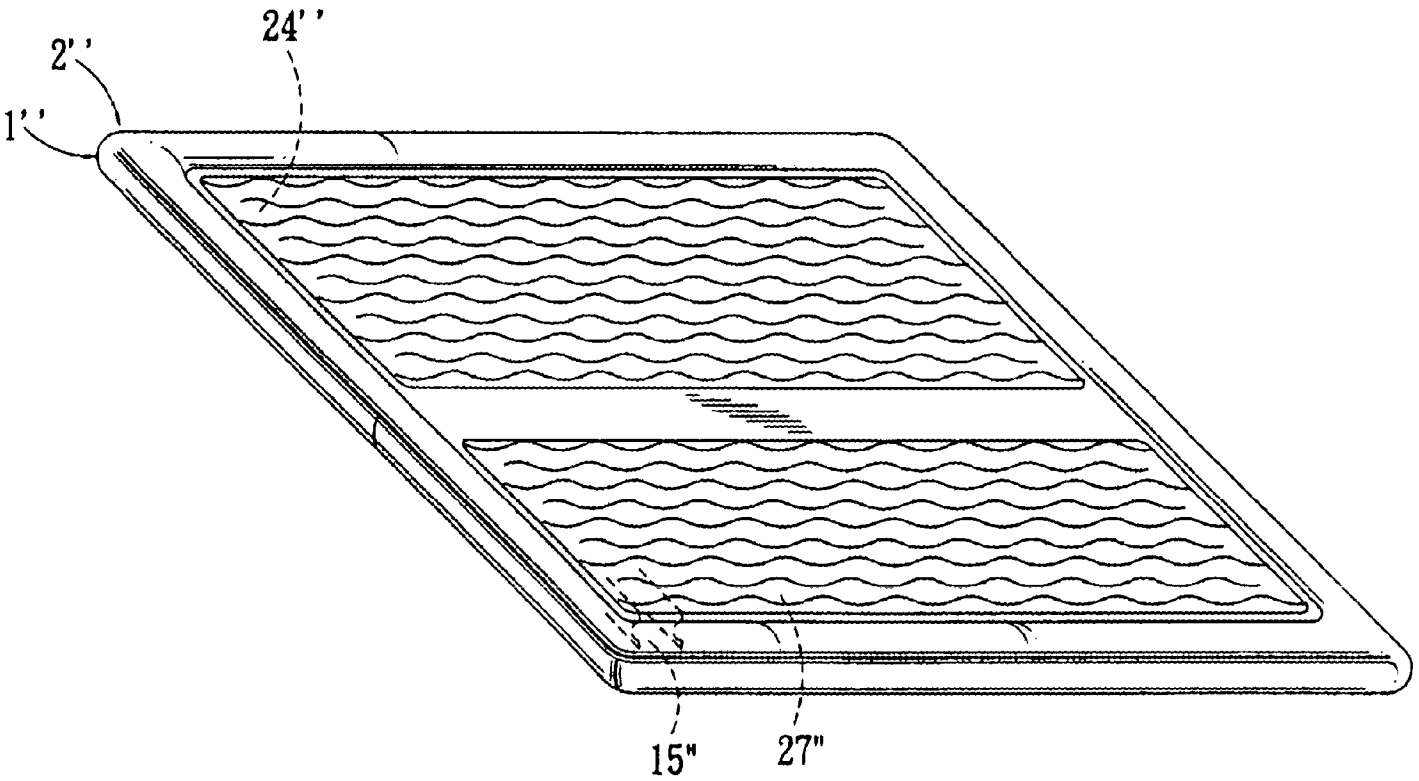
FIG. 8 is a perspective view of another modified preferred embodiment of the present invention.

Referring to FIG. 8, another modified preferred embodiment of an inflatable mattress according to the present invention is shown to be similar to the embodiment shown in FIGS. 3 to 6 in construction. The main difference resides in that the upper mattress body 2' includes a first half which defines a plurality of first upper chambers 24" in fluid communication with one another, and a second half which defines a plurality of second upper chamber 27" in fluid communication with one another. The lower mattress body 1" defines a plurality of parallel lower chambers 15', the leftmost one of which is in fluid communication with an adjacent one of the first upper chambers 24 via one of the holes and with an adjacent one of the second upper chambers 27 via another one of the holes.

With this invention thus explained, it is apparent that numerous modifications and variations can be made without departing from the scope and spirit of this invention. It is therefore intended that the invention be limited only as indicated in the appended claims.

I claim:

1. An inflatable mattress comprising:

an inflatable upper mattress body defining a plurality of elongated parallel upper chambers that extend in a first longitudinal direction, and that are in fluid communication with one another, and having a bottom wall that confines bottom sides of said upper chambers, that has a peripheral portion, and that is formed with a first hole which is disposed adjacent to said peripheral portion, which is fluid communication with an adjacent one of said upper chambers, and which has a periphery;

an inflatable lower mattress body disposed below and in alignment with said upper mattress body, defining a plurality of elongated parallel lower chambers that extend in a second longitudinal direction, and that are in fluid communication with one another, and having a top wall that confronts said bottom wall of said upper mattress body, that confines top sides of said lower chambers, that has a peripheral portion, and that is formed with a second hole which is disposed adjacent to said peripheral portion of said top wall, which is in fluid communication with an adjacent one of said lower chambers, which is vertically registered with said first hole, and which has a periphery, each of said lower chambers having a transverse cross-section greater than that of said upper chamber, said periphery of said second hole being integrally connected to said periphery of said first hole so as to permit adjoining of said first and second holes, thereby permitting fluid communication of said upper chambers with said lower chambers via said first and second holes.

2. The inflatable mattress as defined in claim 1, wherein said first longitudinal direction is perpendicular to said second longitudinal direction.

3. The inflatable mattress as defined in claim 2, wherein said lower mattress body includes a bottom wall that confines bottom sides of said lower chambers and that has a peripheral portion, and said upper mattress body includes a top wall having a peripheral portion that is integrally connected to said peripheral portion of said bottom wall of said upper mattress body and that extends outwardly and downwardly therefrom to integrally connect with said peripheral portion of said bottom wall of said lower mattress body so as to form a looped channel which surrounds said upper and lower chambers and which is in fluid communication with said lower chambers, said looped channel having a top end that is substantially flush with said top wall of said upper mattress body, and a bottom end that is substantially flush with said bottom wall of said lower mattress body.

* * * * *